US009816698B2

(12) United States Patent
Wang et al.

(10) Patent No.: US 9,816,698 B2
(45) Date of Patent: Nov. 14, 2017

(54) LIGHTING DEVICE HAVING A LIGHT SOURCE HEAT SINK ARRANGED SEPARATE FROM A DRIVER

(71) Applicant: PHILIPS LIGHTING HOLDING B.V., Eindhoven (NL)

(72) Inventors: Bao Wang, Nanjing (CN); Xiaoqing Duan, Shanghai (CN); Rosen Guo, Shanghai (CN); Chuan Yuan, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 170 days.

(21) Appl. No.: 14/403,197

(22) PCT Filed: May 14, 2013

(86) PCT No.: PCT/IB2013/053931

§ 371 (c)(1),
(2) Date: Nov. 24, 2014

(87) PCT Pub. No.: WO2013/179172

PCT Pub. Date: Dec. 5, 2013

(65) Prior Publication Data

US 2015/0138777 A1 May 21, 2015

(30) Foreign Application Priority Data

May 29, 2012 (WO) ..... PCT/CN2012/076219

(51) Int. Cl.
*F21V 29/10* (2015.01)
*F21V 29/70* (2015.01)
(Continued)

(52) U.S. Cl.
CPC ..... *F21V 29/70* (2015.01); *F21K 9/232* (2016.08); *F21V 7/0008* (2013.01); *F21V 23/001* (2013.01); *F21V 23/002* (2013.01); *F21V 23/008* (2013.01); *F21V 29/004* (2013.01); *F21V 29/78* (2015.01); *F21K 9/60* (2016.08); *F21V 7/0025* (2013.01); *F21V 7/04* (2013.01); *F21Y 2115/10* (2016.08)

(58) Field of Classification Search
CPC ..... F21V 29/70; F21V 29/77; F21V 23/002; F21K 9/232; F21K 9/238
See application file for complete search history.

(56) References Cited

U.S. PATENT DOCUMENTS 4,143,411 A 3/1979 Roberts
8,746,915 B2 * 6/2014 Villard ..... F21K 9/90 165/185
(Continued)

FOREIGN PATENT DOCUMENTS

JP 2010062005 A 3/2010
JP 2011040238 A 2/2011
(Continued)

*Primary Examiner* — Robert May
*Assistant Examiner* — Leah S Macchiarolo

(57) ABSTRACT

A lighting device (1) comprising a driver (7) arranged at a base (2) of the lighting device (1), a heat sink (14) arranged at a portion (3) of the lighting device (1), separate from the driver (7), a light source (13) mounted to the heat sink (14), and a wire (10) arranged to electrically connect the light source (13) to the driver (7), wherein a portion of the wire (10) extending from the base (2) to the portion of the lighting device (1) is arranged to be exposed to light from the light source (13). The present embodiment is advantageous in that the thermal performance is improved and the lifetime of the lighting device (1) is increased. Further, the exposed wire (10) may be illuminated by the light source (13) and visible from outside the lighting device (1), thereby having the appearance of a filament.

9 Claims, 3 Drawing Sheets

(51) Int. Cl.

| | |
|---|---|
| ***F21V 29/00*** | (2015.01) |
| ***F21V 7/00*** | (2006.01) |
| ***F21V 23/00*** | (2015.01) |
| ***F21V 29/78*** | (2015.01) |
| ***F21K 9/232*** | (2016.01) |
| *F21V 7/04* | (2006.01) |
| *F21K 9/60* | (2016.01) |
| *F21Y 115/10* | (2016.01) |

(56) References Cited

U.S. PATENT DOCUMENTS

| | | | | |
|---|---|---|---|---|
| 9,052,067 | B2 * | 6/2015 | van de Ven | F21V 7/0016 |
| 9,310,065 | B2 * | 4/2016 | Hussell | F21V 29/004 |
| 2008/0310158 | A1 * | 12/2008 | Harbers | F21K 9/54 362/240 |
| 2010/0207502 | A1 | 8/2010 | Cao et al. | |
| 2015/0308628 | A1 * | 10/2015 | Athalye | F21K 9/135 362/650 |

FOREIGN PATENT DOCUMENTS

| | | | |
|---|---|---|---|
| JP | 2011134616 | A | 7/2011 |
| JP | 2011146253 | A | 7/2011 |
| WO | 0063977 | A1 | 10/2000 |
| WO | 2010144572 | A2 | 12/2010 |
| WO | 2011042357 | A1 | 4/2011 |
| WO | 2011077795 | A1 | 6/2011 |
| WO | 2011089103 | A1 | 7/2011 |
| WO | WO2012011279 | A1 | 1/2012 |

* cited by examiner

LIGHTING DEVICE HAVING A LIGHT SOURCE HEAT SINK ARRANGED SEPARATE FROM A DRIVER

CROSS-REFERENCE TO PRIOR APPLICATIONS

This application is the U.S. National Phase application under 35 U.S.C. §371 of International Application No. PCT/IB13/053931, filed on May 14, 2013, which claims the benefit of International Application No. PCT/CN2012/076219, filed on May 29, 2012. These applications are hereby incorporated by reference herein.

FIELD OF THE INVENTION

The present invention generally relates to the field of lighting device having a light source heat sink arranged separate from a driver of the lighting device for improving the thermal performance of the lighting device.

BACKGROUND OF THE INVENTION

Thermal performance is a critical issue for the lifetime of light emitting diode, LED, based lighting devices. LEDs normally generate a majority of the heat in a lighting device, while the driver (for electrically driving the LEDs) only generates a small part of the heat. The LEDs can withstand relatively high temperatures compared to the driver, in which some components are sensitive to high temperatures and degrade in time if exposed to heat. However, in current LED-based lighting devices, the LEDs and the driver are normally arranged in proximity to each other and in connection to the same heat sink. As heat generated by the LEDs adversely affects the driver, high demands are put on heat dissipation from the driver for obtaining acceptable lifetimes of such lighting devices. For enhancing heat dissipation, the driver is normally fixed in a cavity of the heat sink by thermal glue (or thermal potting material), which however is expensive and makes assembly as well as recycling more cumbersome.

WO 2011042357 shows a lighting device having a heat sink arranged in the top, an LED mounted to the lower side of the heat sink, and a cavity for the driver arranged in the lower portion of the lighting device. A tapered reflector extends from the lower portion up to the heat sink and encloses a wire connecting the LED with the driver.

SUMMARY OF THE INVENTION

It is an object of the present invention to provide a lighting device having an improved thermal performance. It is also an object of the present invention to provide a lighting device resembling a conventional incandescent lighting device.

These and other objects are achieved by a lighting device as defined by the independent claim. Embodiments of the invention are defined by the dependent claims.

According to an aspect of the invention, a lighting device is provided. The lighting device comprises a driver arranged at a base of the lighting device, a heat sink arranged at a portion of the lighting device, separate from the driver, a light source mounted to the heat sink, and a wire arranged to electrically connect the light source to the driver. A portion of the wire extending from the base to the portion of the lighting device is arranged to be exposed to light from the light source.

The present invention uses the concept of separating the light source and the driver spatially and thermally by arranging the heat sink, which the light source is mounted to, separate from the driver, thereby improving the thermal performance of the lighting device. Heat from the light source is dissipated via the heat sink and heat transfer from the heat sink to the driver is reduced due to the separation of the two components, which improves the thermal performance and increases the lifetime of the lighting device. The reduced heat transfer from the heat sink to the driver reduces the need of thermal potting material supporting the driver, whereby assembly and demounting are facilitated and material costs are reduced. The improved thermal performance also enables an increased input power to the light source, as heat generated by the light source affects the driver less.

Further, the present invention is advantageous in that the wire (or cable) is not completely covered by the reflector, as a portion of the wire extending from the base to the portion of the lighting device (at which the heat sink and the light source are located) is arranged to be exposed to light from the light source. The exposed wire may hence be illuminated by the light source and visible from outside the lighting device, thereby having the appearance of a filament. Accordingly, the lighting device better resembles an incandescent lighting device than prior art lighting devices, in which the wire is completely covered by a reflector. Resemblance of incandescent lighting devices is a critical issue in designing LED-based replacement lamps and implies technical challenges. The resemblance is a critical factor for increasing the use of LED-based replacement lamps to thereby reduce energy consumption. With the present invention, the incandescent lighting device resemblance is improved by utilizing the wire interconnecting the light source and the driver and hence, additional components for resembling of a filament are not necessary. Prior art lighting devices, are designed to hide the wire interconnecting the light source and the driver, but the inventors have realized that it may be utilized for resembling a filament.

In an embodiment of the present invention, the exposed portion of the wire may be adapted to reflect light from the light source out of the lighting device, thereby making the wire more visible from outside the lighting device and increasing the resemblance of the wire to a filament (of e.g. an incandescent lamp). Further, the reflecting portion of the wire affects the light distribution of the lighting device, as it redirects light from the light source and may contribute to making the light distribution slightly more omnidirectional.

According to an embodiment, the lighting device may further comprise a reflector arranged at the base of the lighting device for reflecting light from the light source out of the lighting device. The present embodiment is advantageous in that the light output of the lighting device is increased, as light emitted from the light source towards the base is redirected out of the lighting device. For example, the reflector and the light source may be oppositely arranged. Further, the shape of the reflector may be adapted to redirect light from the light source into directions at which direct illumination from the light source is poor, such as in lateral and backward directions relative to a main forward emission direction of the light source. Light in such lateral and backwards directions may otherwise be shadowed by the heat sink at which the light source is mounted. Further, the reflector may function as a cover for the driver.

In an embodiment, the reflector may extend towards, but not up to, the portion of the lighting device, thereby leaving a space between the upper end of the reflector (i.e. the end of the reflector facing the portion of the lighting device) and the portion at which the heat sink is arranged. Preferably, the reflector may extend towards, but not up to, the heat sink. With the present embodiment, the wire is more visible from any viewing angle, as the reflector obscures the wire less, thereby further improving the resemblance to an incandescent lighting device.

In an embodiment, the reflector may be tapered in a direction from the base towards the light source, whereby the reflector is adapted to reflect light from the light source in lateral and backward directions relative to a main forward emission direction of the light source. The present embodiment is advantageous in that the reflector widens the light output profile, thereby making it more omnidirectional.

According to an embodiment of the present invention, the reflector may have a surface structure comprising one or more of: grooves, prisms and a scattering pattern, thereby smoothening the light output profile. The scattering pattern may e.g. comprise dots or a grid. Further, the scattering pattern may comprise scattering particles or a rough (or diffusing) surface structure at the reflector.

According to an embodiment, the reflector may enclose the driver in a cavity of the base, thereby protecting the driver and making the driver less visible (and possibly not visible at all) from outside the lighting device. For example, the cavity may be defined in an additional heat sink for cooling the driver (such heat sink will be described in more detail further below in the present disclosure). Further, the enclosure of the driver in the base improves thermal insulation between the driver at one end and the light source and its heat sink at the other end. The reflector may e.g. be made of plastics or ceramics, and preferably have a low thermal conductivity for thermally shielding the driver from the light source.

According to an embodiment of the present invention, the exposed portion of the wire may be at least partly enameled, thereby further increasing the resemblance of the wire to a filament. For example, the enamel (or any other cover of the wire) may be transparent, thereby making the metal (copper) core of the wire visible and the wire even more similar to a tungsten filament.

In an embodiment of the present invention, a segment of the exposed portion of the wire may be arranged as a coil for further improving the filament appearance of the wire. The segment of the exposed portion of the wire may in other words be curled.

According to an embodiment, the lighting device may further comprise an additional heat sink (which may be referred to as a driver heat sink) arranged at the base of the lighting device for cooling the driver. The present invention is advantageous in that heat dissipation from the driver is enhanced, thereby further improving the thermal performance of the lighting device. The driver heat sink may have a reduced size compared to heat sinks in prior art lighting devices, which have to be sufficiently large to manage heat dissipation from both the driver and the light source. In the present embodiment, the size of the heat sink may be adapted to manage heat dissipation merely from the driver, as heat dissipation from the light source is effected by the other heat sink (which may be referred to as the light source heat sink).

In an embodiment, the lighting device may further comprise an envelope arranged to enclose at least the light source and the exposed portion of the wire. The envelope may be diffuse (comprise a scattering structure) for reducing glare from the light source, or clear making the interior of the lighting device (including the wire) visible from outside the lighting device.

According to an embodiment of the present invention, the portion of the lighting device may be arranged opposite to the base, thereby spatially separating the light source heat sink from the driver. In the present embodiment, the portion of the lighting device may be referred to as an upper portion of the lighting device (relative to the base, which then may be referred to as a lower portion). The light source, which in the present embodiment is, accordingly, located at the upper portion of the lighting device, may be arranged to emit light towards the base, at which a reflector is preferably arranged.

It is noted that the invention relates to all possible combinations of features recited in the claims. Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail, with reference to the appended drawings showing embodiments of the invention.

All the figures are schematic, not necessarily to scale, and generally only show parts which are necessary in order to elucidate the invention, wherein other parts may be omitted or merely suggested.

DETAILED DESCRIPTION

Figure 1:
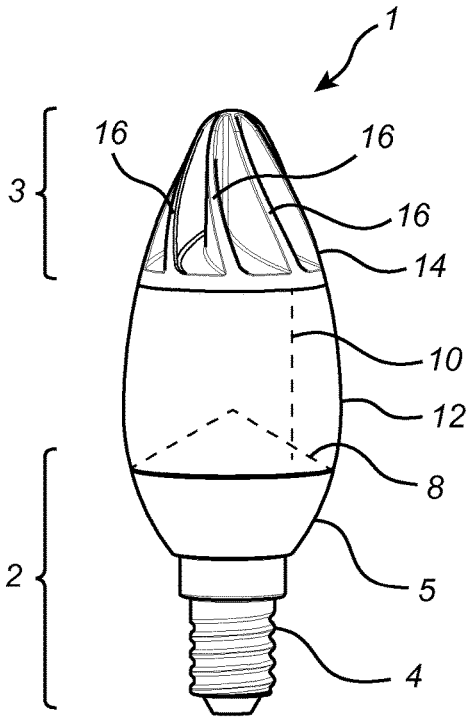
FIG. 1 shows a lighting device according to an embodiment of the present invention.
Figure 2:
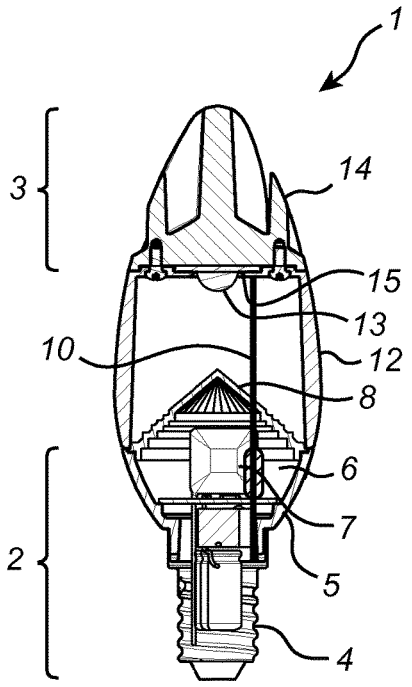
FIG. 2 is a cross sectional view of the lighting device shown in FIG. 1.
Figure 3:
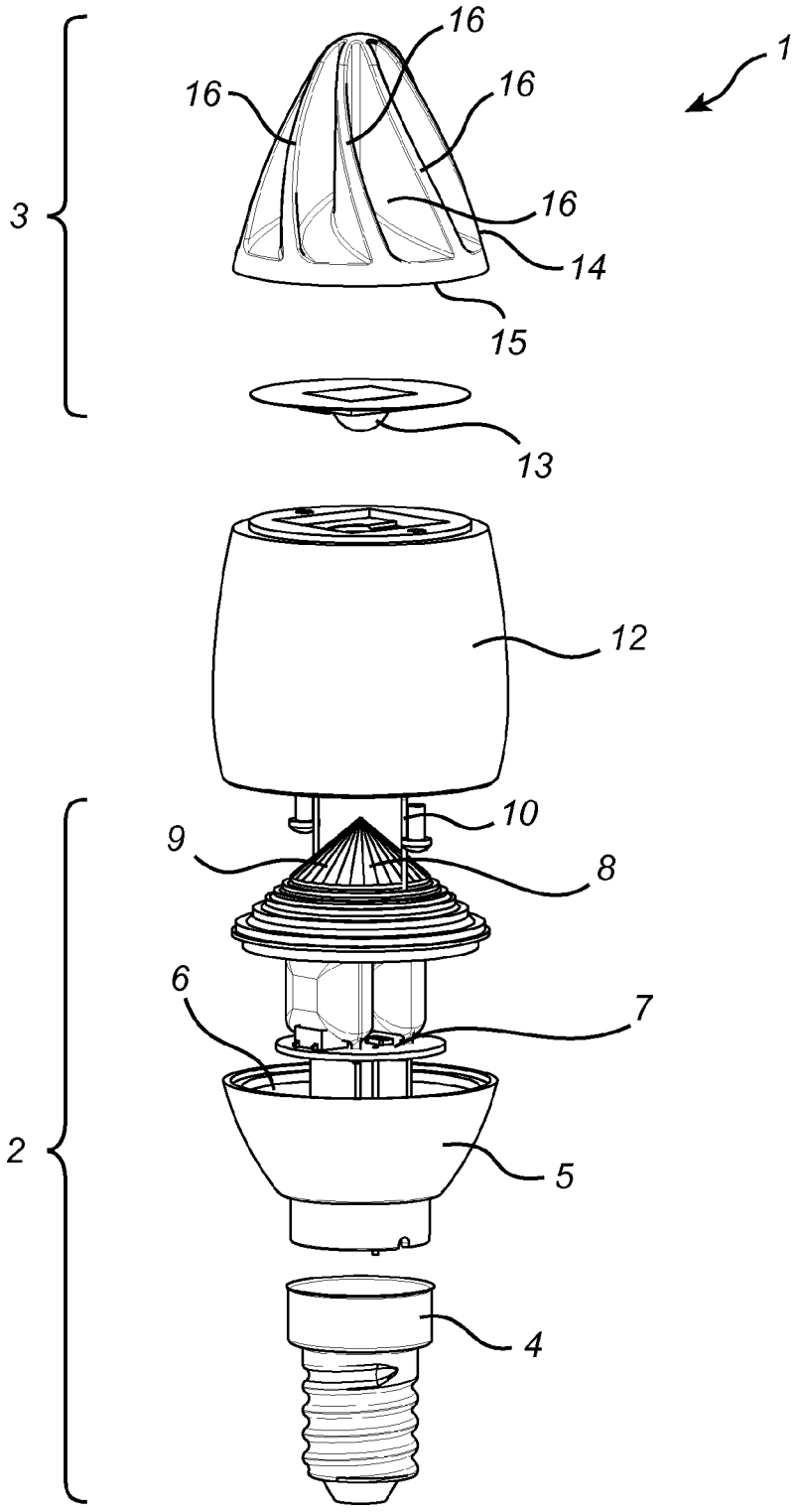
FIG. 3 is an exploded view of the lighting device shown in FIGS. 1 and 2.

With reference to FIGS. 1-3, a lighting device according to an embodiment of the present invention will be described.

FIGS. 1-3 show a lighting device 1 having a base 2 (or lower portion) and an upper portion 3 opposite to the base 2. At the base 2 of the lighting device 1, a cap 4 (such as a threaded cap) for fitting the lighting device 1 in a lamp fitting and a driver heat sink 5 (also referred to as an additional heat sink in the present disclosure) defining a cavity 6 are arranged. In the cavity 6, a driver 7 for driving a light source 13 of the lighting device 1 (such as a printed circuit board, PCB, driver) is arranged. Preferably, the driver 7 is mounted in the cavity 6 without (or at least with just a small amount of) thermal glue or potting for facilitating assembly as well as recycling of the lighting device 1. The driver heat sink 5 may be made of a material having high thermal conductivity, such as a metal, e.g. aluminum. Alternatively, the driver heat sink 5 may be omitted and a supporting element, of a similar shape and made of e.g. ceramic or plastic, may instead define the cavity 6. Such alternative supporting element is possible since the driver 7 only produces a rather small amount of heat, whereby a heat sink for cooling the driver in some cases may be optional.

The driver 7 is enclosed in the cavity 6 of the base 2 by a reflector 8 having a shape which is tapered towards the upper portion 3 of the lighting device 1. For example, the reflector 8 may be conical. The reflector 8 may preferably be made of plastic (which is cheap, light and easy to shape) or any other thermally insulating material. Further, the upper surface, i.e. the surface of the reflector 8 facing the upper portion 3, is coated with a reflective material, such as a film or layer. In an embodiment, structures for achieving a desired light output profile may be comprised in the reflector 8. In the example shown in FIG. 3, grooves 9 are provided in the reflector for smoothening the light distribution. Alternatively, or as a complement, prism-shapes and/or scattering patterns (not shown) may be provided in the reflector 8.

At the upper portion 3, such as at the top most portion, of the lighting device 1, a heat sink 14 is arranged and, at an underside 15 of the heat sink 14 (i.e. the side 15 of the heat sink 14 facing the base 2 of the lighting device 1), the light source 13 is arranged. The light source 13 (or the PCB at which light source 13 is connected) may be attached onto the heat sink 14 with e.g. glue or screw. The heat sink 14 is adapted to dissipate heat from the light source 13 and may therefore be made of metal (such as aluminum) and may preferably be provided with fins 16 (or ribs) for further improving heat dissipation from the light source 13.

An envelope 12 encloses the interior of the lighting device 1 and reaches at least from the base 2 to the upper portion 3 of the lighting device 1. The envelope 12 may be diffuse (scattering particles may then be enclosed in the envelope 12) or clear, and made of e.g. glass or plastic.

The light source 13 is electrically connected to the driver 7 by a wire 10 running inside the envelope 10 from the driver 7 in the base 2 up to the light source 13 at the upper portion 3. As neither the reflector 8 nor any other component of the lighting device 1 obscures the wire 10, the wire 10 is exposed to light from the light source 13 and may be visible through the envelope 12, in particular if the envelope 12 is clear, from outside the lighting device 1. It will be appreciated that the wire 10 may be visible both if the light source 13 is on or off. As the wire 10 is exposed and hence visible from outside the lighting device 1, the wire 10 may be assimilated as a filament, such as for incandescent lamps. The wire 10 may be arranged separate from the envelope 12 and run freely from the base 2 up to the upper portion 3. Conductors for both current directions (to and from the light source 13) may be included in the same wire 10, whereby a single wire 10 is sufficient (as shown in FIGS. 1-3). However, it will be appreciated that the conductors for the two current directions may be comprised in separate wires, whereby two wires may extend from the driver to the light source 13 (not shown). It is also conceivable that the lighting device may comprise several light sources (not shown), wherein one or more wires may connect the light sources to the driver.

For further improving the resemblance of a filament, at least a part of the exposed portion of the wire 10 may be provided with a coating. The coating may e.g. comprise enamel for slightly reflecting light from the light source 13 out of the lighting device 1. The enamel (or coating) may be transparent, whereby the metal core of the wire 10 is visible. Alternatively, or in combination, the coating may comprise luminescent material, such as yellow/red pigments or dye, for tuning impinging light in respect of color. The wire 10 may then better resemble a glowing filament.

In the present embodiment, the wire 10 runs straight from the base 2 up to the upper portion 3, but it will be appreciated that the wire 10 may have any desired shape.

Figure 4:
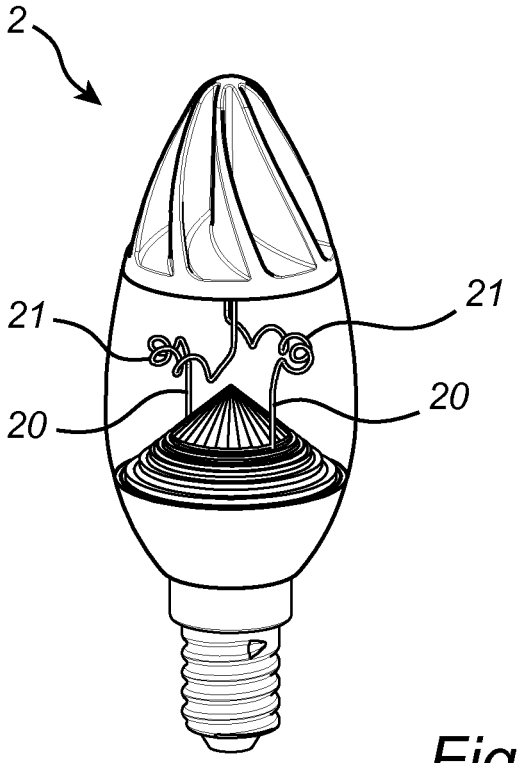
FIG. 4 shows a lighting device according to another embodiment of the present invention.

With reference to FIG. 4, a lighting device according to another embodiment of the present invention will be described.

FIG. 4 shows a lighting device 2 which may be identical to the lighting device 1 described with reference to FIGS. 1-3, except for the shape of the wire 20. In the present embodiment, a segment of the exposed portion of the wire 10 is arranged as a coil 21 for further improving the resemblance to a filament. Further, the conductors for the two current directions between the driver and the light source are comprised in separate wires 20, whereby two wires 20 extend from the driver to the light source.

The person skilled in the art realizes that the present invention by no means is limited to the preferred embodiments described above. On the contrary, many modifications and variations are possible within the scope of the appended claims. It should be noted that the above-mentioned embodiments illustrate rather than limit the invention and that those skilled in the art will be able to design alternative embodiments without departing from the scope of the appended claims. In the claims, any reference signs placed between parentheses shall not be constructed as limiting the claim. The word "comprising" does not exclude the presence of elements or steps not listed in a claim. The word "a" or "an" preceding an element does not exclude the presence of a plurality of such elements. The usage of the words first, second and third, etc., does not indicate any ordering. These words are to be interpreted as names. No specific sequence of acts is intended to be required unless specifically indicated.

The invention claimed is:

1. A lighting device, comprising:

a driver arranged at a base of the lighting device;

a heat sink arranged at a portion of the lighting device, separate from the driver;

a light source mounted to the heat sink;

a wire arranged to electrically connect the light source to the driver; and an envelope arranged to enclose at least the light source and an exposed portion of the wire;

a reflector arranged at the base of the lighting device and positioned to reflect light from the light source out of the lighting device, the reflector tapering towards the portion of the lighting device with the heat sink such that the reflector reflects light from the light source out of the envelope in lateral and backward directions relative to a main forwards emission direction of the light source;

wherein the wire is arranged separate from the envelope and runs freely from the base to the portion of the lighting device with the heat sink, the wire not contacting the envelope between the base and the portion of the lighting device with the heat sink, and wherein a portion of the wire extending from the base to said portion of the lighting device with the heat sink is arranged to be exposed to light from the light source.

2. The lighting device as defined in claim 1, wherein the exposed portion of the wire is adapted to reflect light from the light source out of the lighting device.

3. The lighting device as defined in claim 1, wherein the reflector extends towards, but not up to, the portion of the lighting device with the heat sink.

4. The lighting device as defined in claim 1, wherein the reflector has a surface structure comprising one or more of: grooves, prisms and a scattering pattern.

5. The lighting device as defined in claim 4, wherein the reflector encloses the driver in a cavity of the base.

6. The lighting device as defined in claim 5, wherein the exposed portion of the wire is at least partly enameled.

7. The lighting device as defined in claim 6, wherein a segment of the exposed portion of the wire is arranged as a coil.

8. The lighting device as defined in claim 7, further comprising an additional heat sink arranged at the base of the lighting device for cooling the driver.

9. The lighting device as defined in claim 8, wherein the portion of the lighting device with the heat sink is arranged opposite to the base.

* * * * *